US011073161B2

(12) United States Patent
Blad et al.

(10) Patent No.: US 11,073,161 B2
(45) Date of Patent: Jul. 27, 2021

(54) CENTRIFUGAL PUMP ASSEMBLY

(71) Applicant: GRUNDFOS HOLDING A/S, Bjerringbro (DK)

(72) Inventors: Thomas Blad, Bjerringbro (DK); Christian Blad, Aalborg (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 36 days.

(21) Appl. No.: 16/493,125

(22) PCT Filed: Mar. 13, 2018

(86) PCT No.: PCT/EP2018/056187
§ 371 (c)(1),
(2) Date: Sep. 11, 2019

(87) PCT Pub. No.: WO2018/167031
PCT Pub. Date: Sep. 20, 2018

(65) Prior Publication Data

US 2020/0116161 A1 Apr. 16, 2020

(30) Foreign Application Priority Data

Mar. 14, 2017 (EP) ..... 17160836

(51) Int. Cl.
*F04D 29/42* (2006.01)
*F04D 13/06* (2006.01)
*F04D 15/00* (2006.01)

(52) U.S. Cl.
CPC ..... *F04D 29/426* (2013.01); *F04D 13/06* (2013.01); *F04D 15/0005* (2013.01); *F04D 15/0022* (2013.01)

(58) Field of Classification Search
CPC .. F04D 13/06; F04D 15/0005; F04D 15/0022; F04D 29/426
See application file for complete search history.

(56) References Cited

U.S. PATENT DOCUMENTS 5,261,786 A * 11/1993 Sidelko ..... F16J 15/164 415/171.1
5,924,432 A 7/1999 Thies et al.
2014/0308115 A1* 10/2014 Popp ..... F01P 5/12 415/148

(Continued)

FOREIGN PATENT DOCUMENTS

DE 44 18 153 A1 11/1995
EP 0 394 140 A1 10/1990
EP 1 403 521 A1 3/2004

*Primary Examiner* — Patrick Hamo
(74) *Attorney, Agent, or Firm* — McGlew and Tuttle, P.C.

(57) ABSTRACT

A hydraulic construction unit includes a centrifugal pump assembly which includes an electrical drive motor and at least one impeller which is driven by the electric drive motor. At least one valve element is arranged such that the valve element is movable by way of a fluid flow which is created by the impeller. At least one section of a wall delimits a flow path in the hydraulic construction unit and is configured to be movable as a moveable section. The movable section of the wall is part of the valve element or is connected to the valve element for movement. The movable section is movable so as to be at least partly effected by friction forces of a fluid flow which runs along the wall.

17 Claims, 13 Drawing Sheets

(56) References Cited

U.S. PATENT DOCUMENTS

| | | | | |
|---|---|---|---|---|
| 2016/0273543 | A1* | 9/2016 | Blad | F04D 29/0416 |
| 2018/0283702 | A1* | 10/2018 | Blad | F24D 19/1024 |
| 2018/0291908 | A1* | 10/2018 | Blad | F24D 3/105 |

* cited by examiner

CENTRIFUGAL PUMP ASSEMBLY

CROSS REFERENCE TO RELATED APPLICATIONS

This application is a United States National Phase Application of International Application PCT/EP2018/056187, filed Mar. 13, 2018, and claims the benefit of priority under 35 U.S.C. § 119 of European Application 17 160 836.7, filed Mar. 14, 2017, the entire contents of which are incorporated herein by reference.

TECHNICAL FIELD

The invention relates to a hydraulic construction unit with a centrifugal pump assembly as well as with at least one valve element which is movable by a fluid flow which is caused by the centrifugal pump assembly.

TECHNICAL BACKGROUND

Hydraulic construction units with centrifugal pump assemblies which comprise valve elements which are moved by the flow in the pump assembly are known. Centrifugal pump assemblies concerning which the flow in the inside of the pump casing can be directed into two different directions by way of a reversal of the rotation direction, so that a switch-over element can be moved between two outlets or two inlets of the centrifugal pump assembly, in order to deliver the flow selectively through one of these, are known. The disadvantage of these known centrifugal pump assemblies is the relatively complicated mechanism or the occurrence of efficiency losses on account of the switching elements which are necessary in the flow path or on account of the necessary rotation direction reversal.

SUMMARY

With regard to these problems, it is the object of the invention to improve a hydraulic construction unit with a centrifugal pump assembly and with a valve element which is movable via the flow which is produced by the centrifugal pump assembly, to the extent that a reliable actuation of the valve element is possible given a simultaneously simple construction of the valve element and a high efficiency.

The hydraulic construction unit according to the invention comprises a centrifugal pump assembly which comprises an electrical drive motor as well as at least one impeller which is rotatingly driven by this. The electrical drive motor here is preferably a wet-running motor, which is to say a drive motor with a can or can pot between the stator and the rotor, so that the rotor can rotate in the fluid to be delivered. Apart from this centrifugal pump assembly, the hydraulic construction unit according to the invention comprises at least one valve element which is arranged and configured such that it is movable by way of a fluid flow which is caused by the impeller, in particular between at least two different switching positions. Apart from the centrifugal pump assembly and the valve element, the hydraulic construction unit preferably comprises at least those flow channels or flow paths which are necessary for the connection of the centrifugal pump assembly to external elements, for example pipe conduits of a heating circuit. Further preferably, the hydraulic construction unit comprises at least a part of the flow paths which are necessary for the connection between the centrifugal pump assembly and the valve element, wherein particularly preferably the valve element with the centrifugal pump assembly forms an integrated construction unit. E.g. the valve element can thus be arranged in the pump casing, in which the impeller rotates.

Further preferably, the hydraulic construction unit is configured for application in a heating facility and/or air-conditioning facility, which means that the centrifugal pump assembly is preferably configured for use as a circulation pump assembly, in order to circulate a fluid heat transfer medium, in particular water, in a circuit of a heating facility or air-conditioning facility. Further preferably, the hydraulic construction unit can be configured as an integrated hydraulic construction unit for a heating facility, in particular for a compact heating facility. Such integrated construction units as a rule comprise all essential flow paths and hydraulic components of the compact heating facility. In particular, a secondary heat exchanger for heating service water can also be integrated into the hydraulic instruction unit. Such a hydraulic construction unit then essentially yet comprises the branches (branch connections or simply connections) for one or more heating circuits, for at least one heat source as well as possibly an inlet for cold service water as well as an outlet for heated service water. Necessary valves, sensors and the centrifugal pump assembly are preferably integrated into the hydraulic construction unit, wherein further preferably at least a part of the necessary flow paths can be formed in single-piece components of cast material, in particular injection moulded plastic.

According to the invention, at least one section of a wall which delimits the flow path in the hydraulic construction unit is configured in a movable manner. This is preferably a flow path, through which the fluid which is delivered by the centrifugal pump assembly flows. The flow therefore flows along the wall and thereby also along the at least one movable section. This movable section of the wall is part of the valve element or is coupled or connected to the valve element for the movement of this. The movable wall can therefore transmit a force energy or movement energy onto the valve element in a direct manner for its movement. The movable section in turn is movable by way of the fluid flow which runs along the wall. The fluid flow therefore via the movable section of the wall can effect a movement of the valve element which is coupled to this section of the wall. The transmission of movement energy from the flow onto the movable section of the wall, according to the invention is at least partly effected by friction forces between the fluid flow and the wall. Particularly preferably, the complete force transmission or energy transmission is effected by way of a friction of the fluid flow on the movable section of the wall. Such a design has the advantage that essentially only loss energy which would occur in any case in the inside of the flow path due to the occurring friction, is utilised for the movement of the valve element. Ideally, the surface of the movable section of the wall has a surface shaping or roughness which does not essentially differ from the characteristics of the surfaces of the remaining wall of the flow path. Additional elements projecting into the flow and causing resistances are preferably not envisaged. Essentially only the usual friction losses therefore occur also on the movable section of the wall, wherein these friction losses can then be utilised for moving the valve element. A very high efficiency can therefore also be realised when actuating the valve element, due to the fact that hydraulic losses are minimised. In particular, on further operation of the centrifugal pump assembly, essentially no additional flow losses occur after the movement of the valve element via the movable section of the wall when this remains in its end position, as would otherwise be the case for example given movable flaps or blades which project into the flow for moving a valve element.

The at least one movable section is preferably arranged in a manner such that it is movable parallel to the fluid flow which runs along the wall. This means that the flow can flow along this movable section of the wall as on adjacent wall parts, without being braked to a greater extent or being compromised by the movable section of the wall. The flow catches the movable section of the wall in the flow direction, preferably solely due to friction forces, and thereby moves the coupled valve element.

The at least one movable section of the wall can delimit a flow path which extends from the pump assembly at the delivery side (which extends at the delivery side of the pump assembly) or however delimit a flow path which extends from the centrifugal pump assembly at the suction side (which extends at the suction side of the pump assembly). Thus for example a flow which flows towards the centrifugal pump assembly at the suction side or a flow which flows away from the pump assembly at the delivery side can move the movable section and thereby the valve element. It is also possible to drive the valve element via flow at the delivery side of the centrifugal pump assembly as well as via a flow at the suction side of the centrifugal pump assembly. In this case, two movable sections which are both part of the valve element or are coupled to the valve element for its drive are provided in two flow paths.

The movable section of the wall, as described above, it preferably configured and arranged in a manner such that it is movable together with the at least valve element by way of an energy loss which is caused by the friction forces at the wall of the flow path. Essentially, no losses in efficiency thus occur due to the valve element and its actuation elements which move the valve element via the flow.

According to a further preferred embodiment, the at least one section of the wall is rotatably mounted in a pump casing and preferably together with the at least one valve element is rotatably mounted in the pump casing. The impeller rotates in the pump casing. Thereby, the impeller produces a likewise rotating flow in the peripheral region. If the section of the wall and preferably also the valve element are rotatable, then this rotating flow can be converted very easily into movement of the valve element, since the rotating flow can catch or co-move the rotatably movable section of the wall in the flow direction by way of frictional forces. Particularly preferably, the rotation axis of the at least one movable section of the wall lies aligned to the rotation axis of the drive motor and of the at least one impeller. Further preferably, the rotation axis of a rotatable valve element is also aligned with the rotation axis of the drive motor and of the impeller.

Usefully, the at least one movable section of the wall is configured in a manner such that the friction forces which act on it due to the fluid flow are larger than those friction forces which occur in a mounting or the mountings of the movable section of the wall and of the at least one valve element. This can be achieved by an accordingly large surface of the movable section of the wall. The surface of the movable wall could also be structured, in order to create a greater friction. What is important here is that the design is such that the forces which are transmitted by the flow onto the movable wall section are larger than the holding forces or friction forces which act upon the movable section of the wall and of the at least one valve element. A movement of the valve element can therefore be created by the flow. It is preferable for at least a part of the surface of the movable section to be distanced as far as possible from the rotation axis, in order to produce an as large as possible torque, so as to produce an as large as possible torque upon the rotatable valve element. Particularly preferably, the movable section of the wall has a disc-like and in particular circular outer contour, wherein the outer diameter of the disc is preferably just as large as the diameter of the impeller in the pump casing.

According to a further preferred embodiment, a movable separating element is provided, said separating element separating a suction chamber in the inside of a pump casing of the centrifugal pump assembly from a delivery chamber which surrounds the impeller, wherein a surface of the separating element which faces the delivery chamber and/or a surface of the separating element which faces the suction chamber forms or comprises the at least one movable section of the wall. Particularly preferably, the complete separating element is movable, in particular rotatable, as has been described above. The separating element can thus preferably be rotatable about a rotation axis which is aligned to the rotation axis of the impeller. Further preferably, the separating element is formed directly by the valve element which is to say that the separating element is part of the valve element. A direct drive of the valve element at the surface of the valve element which forms the movable section of the wall in the flow path can therefore be created.

Further preferably, the separating element annularly surrounds a suction port of the impeller, wherein the separating element can comprise a central opening which is aligned with the suction port, in particular is sealingly engaged with this. The separating element thus forms a common deflector plate between the suction chamber and the delivery chamber of the pump assembly and is simultaneously movable, in order to be able to drive the valve element when the separating element is co-moved by the flow which engages on it or the flow which flows along it.

The valve element is preferably rotatably mounted on a central bearing, wherein the rotation axis of the valve element, as described, preferably extends in a manner aligned to the rotation axis of the drive motor. The central mounting has the advantage that the bearing diameter can be configured in a very small manner, so that the friction losses at the bearing surfaces can be minimized. If the movable section of the wall is part of the valve element, then this section can moreover be situated radially outside the bearing, preferably in a manner radially distanced to the bearing, so that a greater torque is created by the flow which engages on the movable section, for moving the valve element.

Further preferably, the valve element is movable between at least two switching positions, wherein these switching positions can be limited or defined for example by stops. However, it is also conceivable for the valve element to be able to assume more than two switching positions. According to a first embodiment of the invention, the valve element can act as a switch-over valve between two flow paths, wherein then in a first switching position, a first flow path is opened and a second flow path is closed. Conversely, in a section switching position, the first flow path is closed and the second flow path is opened. According to a second embodiment of the invention, the valve element can alternatively or additionally act as a mixing valve.

The valve element can preferably interact with at least two valve openings of two flow channels, in a manner such that the valve openings of the flow channels are opened to a different extent in a manner depending on the switching position of the valve element. In the case of a switch-over valve, this means that the valve openings are either completely closed or completely opened. With the design as a mixing valve, intermediate positions, at which the valve openings are only partly opened, are also possible. On use of the mixing valve, the valve element is preferably configured such given its movement, it closes one of the valve openings further and simultaneously opens the other valve opening further. This is preferably effected by the same amount. This can be achieved in a particularly simple manner by way of a single-piece valve element being provided, said valve element being able to cover both valve openings. However, according to the invention, an arrangement of two valve elements which are coupled to one another in a suitable manner for a common movement is also to be understood as a valve element.

Further preferably, the at least two valve openings each span a surface which extends parallel to a movement direction of the valve element between the at least two switching positions. This means that for opening and closing the valve openings, the valve element is preferably moved parallel to these openings or to the surfaces which are spanned by the valve openings, and does not approach the valve openings and move away from them for the opening and closure. This permits a very simple design of two valve openings which are to be reciprocally opened and closed by a valve element. Moreover, a pressure prevailing at the valve openings does not act in the movement direction of the valve element.

Further preferably, the valve element is configured and arranged in a manner such that it is movable along a first movement path or a first movement way between at least two switching positions by way of the fluid flow and can be subjected to force or is movable along a second movement path or along a second movement way by way of a pressure which is produced by the impeller, wherein the second movement path runs in an angled manner to the first movement path. This permits the change between the switching positions to be carried out with hardly any friction, since in this condition the valve element preferably does not bear on necessary valve seats and/or contact surfaces (bearing surfaces), or bears on these with relatively low friction. The valve element can therefore be subjected to force by way of the pressure, so that it comes to bear on the valve seats or is pressed with a greater force against the valve seats and/or contact surfaces in a sealing manner. A greater friction or holding force between the valve element and the valve seats or further contact surfaces then occurs in this condition, said friction or holding force simultaneously being able to serve for holding the valve element in the reached switching position.

The valve element is thus preferably movable along the second movement path between a first released position, in which the valve element is movable between the at least two switching positions, and a bearing position (contacting position), at which it bears upon at least one contact surface. This is to be understood as the valve element in the first position possibly likewise being able to bear on the contact surface, but such that it can slide along the contact surface with relatively little friction. In contrast, in the second position, the valve element is pressed onto the contact surface such that a greater friction occurs between the valve element and the contact surface, said friction producing a holding force which prevents a further movement of the valve element via the fluid flow, as has been described beforehand. By way of such a design, it is possible to move the valve element by way of a suitable drive of the drive motor and the formation of a fluid flow, as long as such a fluid pressure which presses the valve element into bearing contact with the contact surface is not reached. Such a pressure can be achieved byway of increasing the speed and in particular by way of a very rapid increase in speed of the drive motor, so that the valve element can then be held in a reached switching position in a targeted manner. The pressure, at which the valve element comes to bear on the contact surface in a holding manner, is selected such that it is lower than the lowest operating pressure on normal operation of the centrifugal pump assembly. The pressure can be adjusted or set by a restoring element such as a restoring spring which is arranged such that it moves the valve element into the released first position given a lower pressure.

The valve element and the contact surface are preferably configured such that they non-positively and/or positively engage with one another in the bearing position, wherein preferably a greater force can be transmitted via this engagement than between the fluid flow and the at least one movable section of the wall. It is therefore ensured that when it is in bearing contact with the contact surface, the valve element is held in the reached switching position and cannot be moved further by the fluid flow. The fluid flow can then flow along the movable section of the wall, wherein this wall is no longer co-moved.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
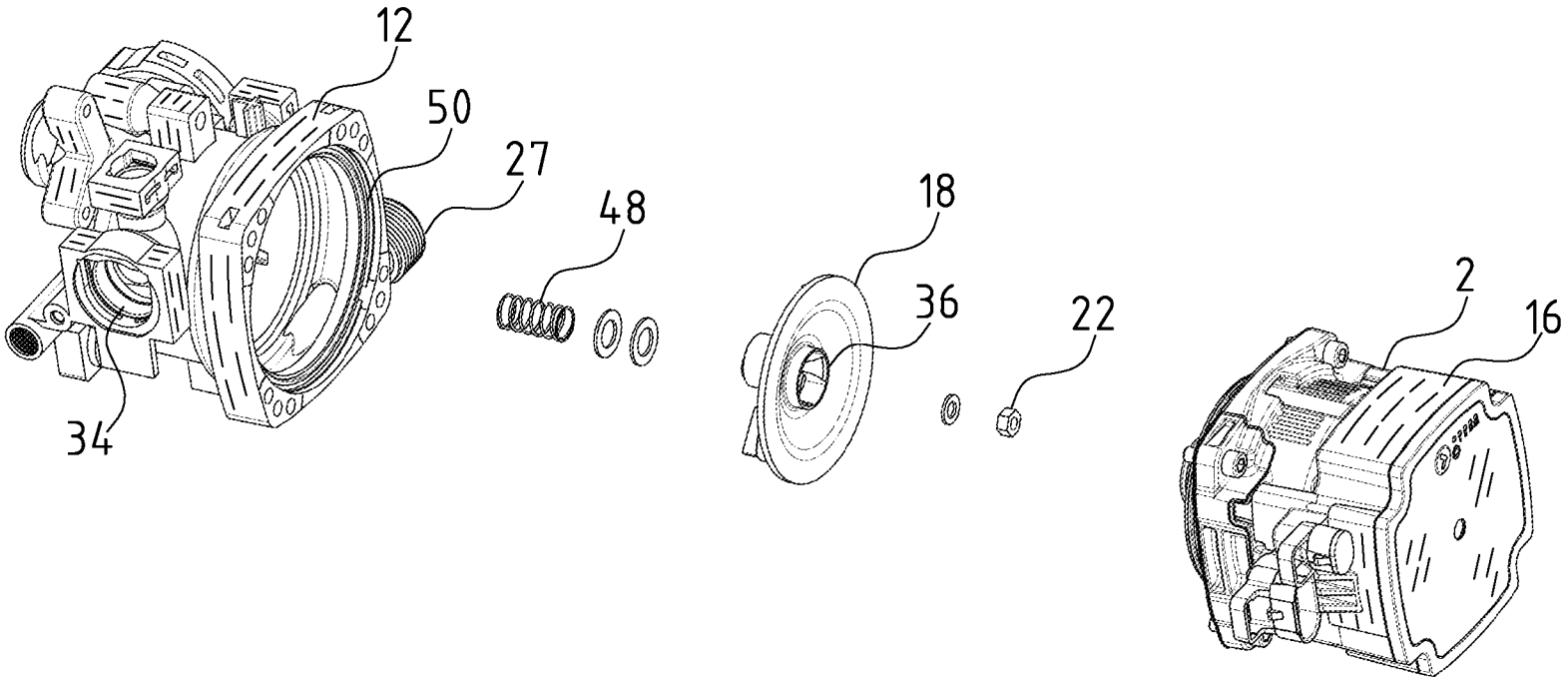
FIG. 1 is an exploded view of a centrifugal pump assembly according to a first embodiment of the invention.
Figure 3:
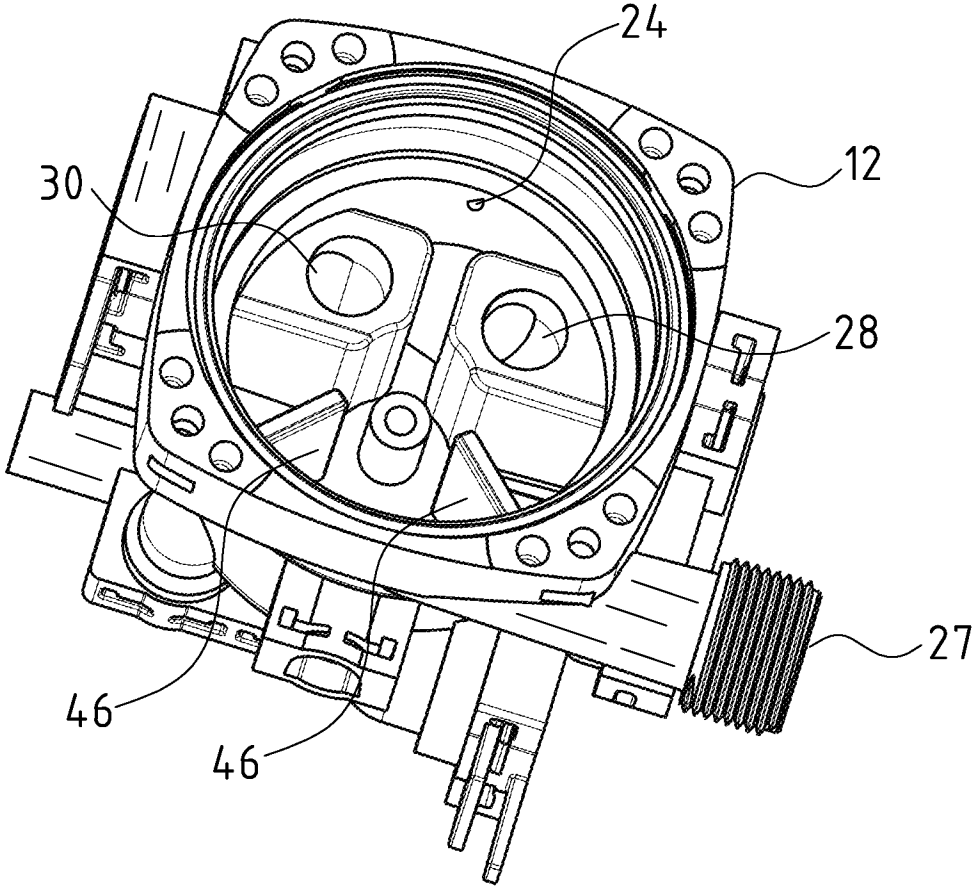
FIG. 3 is a perspective view of the pump casing of the centrifugal pump assembly according to FIG. 1 in the opened condition.
Figure 2:
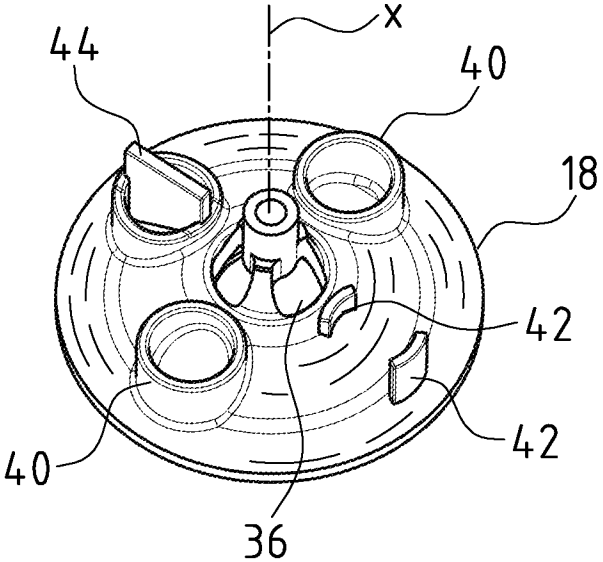
FIG. 2 is a perspective view of the lower side of the valve element of the centrifugal pump assembly according to FIG. 1.
Figure 4:
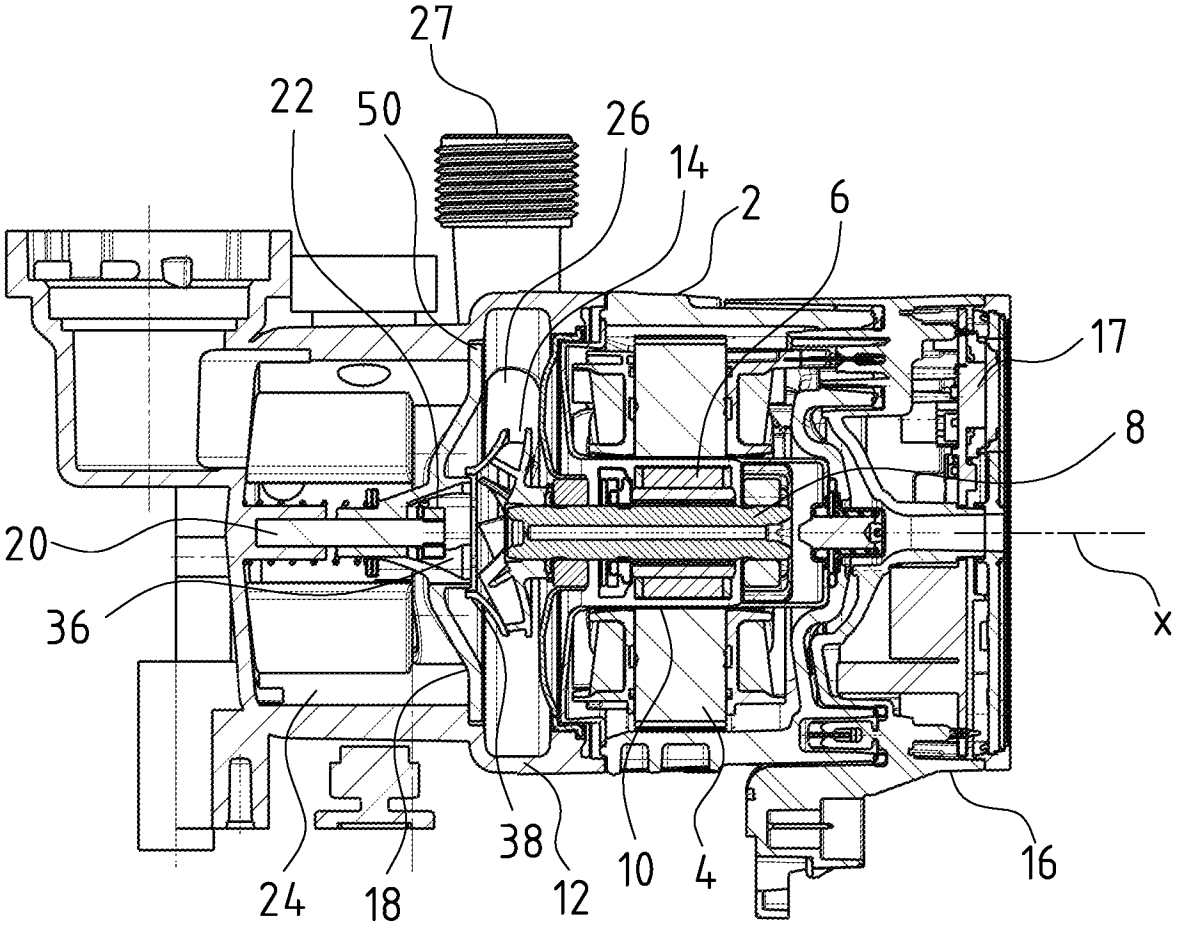
FIG. 4 is a sectioned view of the centrifugal pump assembly according to FIG. 1.

Referring to the drawings, the embodiment examples of the centrifugal pump assembly according to the invention which are described in the following description relate to applications in heating systems and/or air conditioning systems, in which a fluid heat transfer medium, in particular water is circulated by the centrifugal pump assembly.

The centrifugal pump assembly according to the first embodiment of the invention comprises a motor casing 2, in which an electrical drive motor is arranged. This in the known manner comprises a stator 4 as well as a rotor 6 which is arranged on a rotor shaft 8. The rotor 6 rotates in a rotor space which is separated from the stator space, in which the stator 4 is arranged, by way of a can or a canned pot 10. This means that here it is the case of a wet-running electrical drive motor. The motor casing 2 is connected to a pump casing 12 at an axial end, in which pump casing an impeller 14 which is connected to the rotor shaft 8 in a rotationally fixed manner rotates.

An electronics casing 16 which contains control electronics or a control device for the activation of the electrical drive motor in the pump casing 2 is arranged at the axial end of the motor casing 2 which is opposite to the pump casing 12. The electronics casing 16 could also be arranged at another side of the pump casing 2 in a corresponding manner.

A movable valve element 18 is moreover arranged in the pump casing 12. This valve element 18 is rotatably mounted on a pivot 20 in the inside of the pump casing 12, and specifically such that the rotation axis of the valve element 18 is aligned with the rotation axis X of the impeller 14. The pivot 20 is fixed to the base of the pump casing 12 in a rotationally fixed manner. The valve element 18 is not only rotatable about the pivot 20 but is movable in the longitudinal direction X by a certain amount. This linear movability is limited in one direction by way of the pump casing 12, upon which the valve element 18 abuts with its outer periphery. In the opposite direction, the movability is limited by the nut 22, with which the valve element 18 is fastened on the pivot 20. It is to be understood that a different axial fastening of the valve element 18 to the pivot 20 could also be selected instead of the nut 22.

The valve element 18 forms a separating element which in the pump casing 12 separates a suction chamber 24 from a delivery chamber 26. The impeller 14 rotates in the delivery chamber 26. The delivery chamber 26 is connected to the delivery connection or delivery branch (delivery nozzle) 28 of the centrifugal pump assembly which forms the outlet of the centrifugal pump assembly. Two suction-side inlets 28 and 30, of which the inlet 28 is connected to a first suction branch 32 and the inlet 30 is connected to the second suction branch 34 of the pump casing 12 run out into the suction chamber 24.

Figure 5:
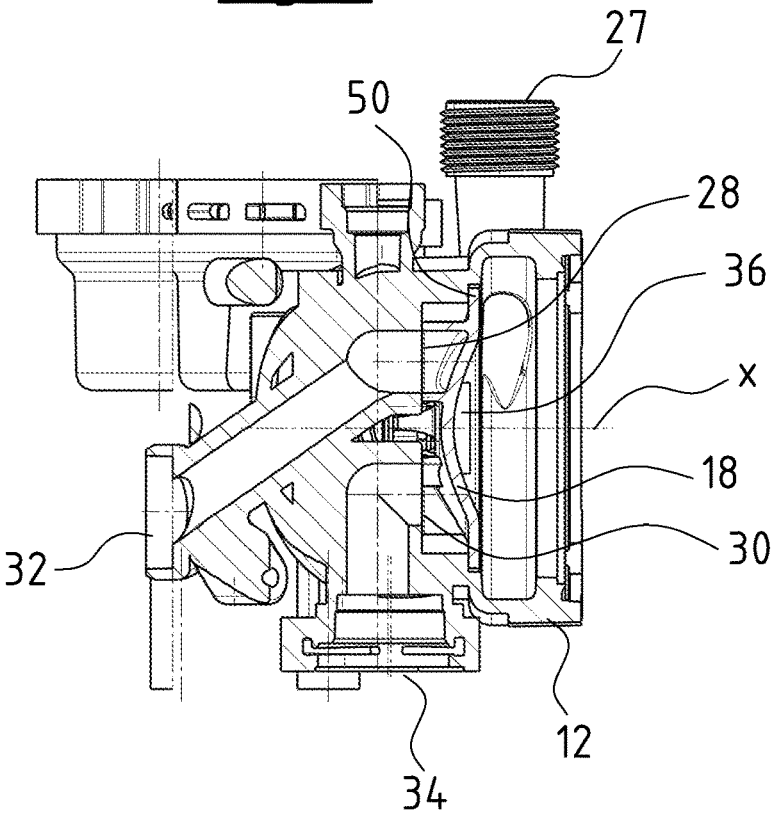
FIG. 5 is a sectioned view of the pump casing of the centrifugal pump assembly according to FIG. 4 with the valve element in a first switching position.
Figure 6:
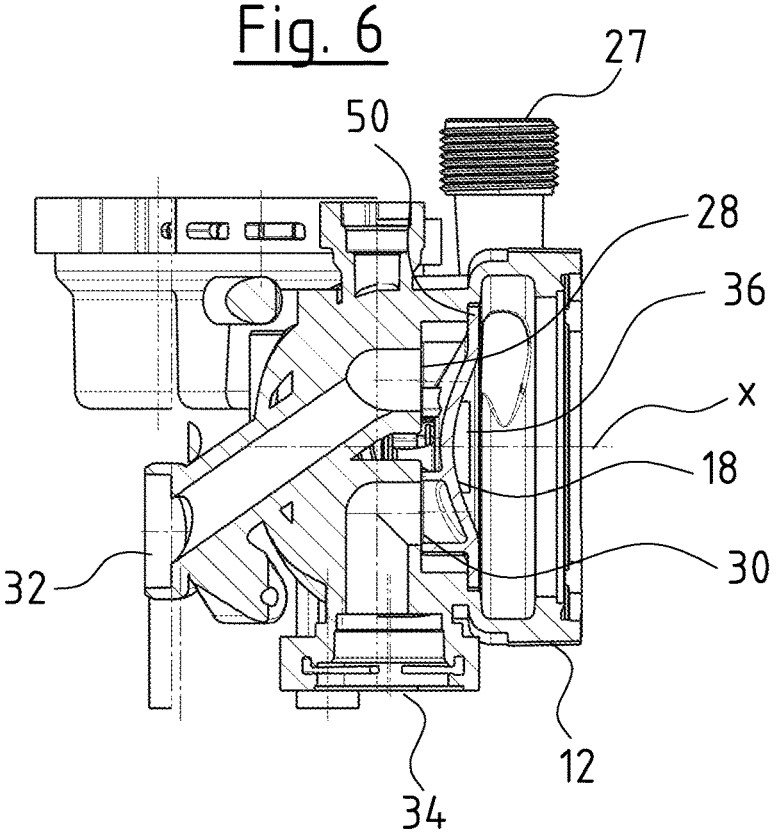
FIG. 6 is a sectioned view according to FIG. 5 with the valve element in a second switching position.

The valve element 18 is configured in a disc-like manner (as a disc) and simultaneously assumes the function of a common deflector plate which separates the suction chamber 24 from the delivery chamber 26. This means that it serves for flow guidance in the region of the delivery chamber and forms a part of the wall of the delivery chamber 26. The valve element 18 comprises a central suction opening 26 which comprises a projecting peripheral collar which is engaged with the suction port 38 of the impeller 14 and is essentially in sealing bearing contact with the suction port 38. Facing the impeller 14, the valve element 18 is configured to be essentially smooth. The valve element at the side which is away from the impeller 14 comprises two annular sealing surfaces 40 which in this embodiment example are situated on closed, tubular stubs (connection pieces or nozzles). The two annular sealing surfaces 40 are arranged on the sealing element 18 at two diametrically opposite positions with respect to the rotation axis X of this element, so that they can come to sealing bear on the base of the pump casing 12 in the peripheral region of the inlets 28 and 30, so as to close the inlets 28 and 30. Support elements 42 are arranged offset to the sealing surfaces 40 at an angular position of 90° and can likewise come to bear on the peripheral region of the inlets 28, 30, but are distanced to one another such that they do not then close the inlets 28, 30. The inlets 28 and 30 do not lie on the diameter line with respect to the rotation axis X, but on a radially offset straight line, so that on rotation of the valve element 18 about the rotation axis X into a first switching position, the inlet 38 is closed by a sealing surface 40 whilst the support elements 42 lie on the inlet 30 and open this. In a second switching position, the inlet 30 is closed by a sealing surface 40 whilst the support elements 42 bear in the peripheral region of the inlet 28 and open this. The first switching position, in which the inlet 38 is closed and the inlet 30 is opened is represented in FIG. 5. The second switching position, in which the inlet 30 is closed and the inlet 28 is opened is represented in FIG. 6. This means that one can switch between the two switching positions by way of a rotation of the valve element about the rotation axis X by 90°. The two switching positions are limited by a stop element 44 which alternately hits two stops 46 in the pump casing 12.

In an idle position, which is to say when the centrifugal pump assembly is not in operation, a spring 48 presses the valve element 18 into released position, in which the outer periphery of the valve element 18 does not sealingly bear on the pump casing 12 and the sealing surfaces 40 do not sealingly bear in the peripheral region of the inlets 28 and 30, so that the valve element 18 can rotate about the axis 20. If the drive motor is now brought into rotation by the control device 17 in the electronics casing 16, so that the impeller 14 rotates, then a peripheral flow which via the friction at the face side of the valve element 18 co-rotates this in the rotation direction of the flow is produced in the delivery chamber 26. The valve element 18 thus forms a movable section of the wall of the delivery chamber 26 which is co-moved by the flow. The control device 17 is configured such that it can drive the drive motor selectively in two rotation directions. The valve element 18 can therefore likewise be moved in two rotation directions about the rotation axis X depending in the rotation direction of the impeller 14, via the flow which is brought into rotation by the impeller 14, since the flow in the peripheral region of the impeller 14 always runs in its rotation direction. The valve element 18 can therefore be rotated between the two switching positions which are limited by the stops 46.

If the impeller 14 rotates at a sufficient speed, then a pressure builds up in the delivery chamber 26 and this pressure produces a pressing force on the surface of the valve element 18 which surrounds the suction opening 36, said pressing force being opposite to the spring force of the spring 48, so that the valve element 18 is moved in the axial direction X against the spring force of the spring 48 such that it comes to sealingly bear at its outer periphery on an annular contact shoulder 50 on the pump casing 12. Depending on the switching position, one of the sealing surfaces 40 simultaneously comes to sealingly bear on the periphery of one of the inlets 28 and 30, so that one of the inlets 28, 30 is closed. The support elements 42 come to bear on the other inlet, so that this inlet remains open and a flow path from this inlet 28, 30 to the suction opening 36 and from there into the inside of the impeller 14 is given. A frictional contact between the valve element 18 and the pump casing 12 is simultaneously created by way of the bearing of the valve element 18 on the contact shoulder 50 and on the sealing surface 40 in the peripheral region of one of the inlets 28, 30. This frictional contact or frictional bearing contact ensures that the valve element 18 is held in the reached switching position. This permits the drive motor to be briefly taken out of operation and to be brought into operation again in the opposite rotation direction without the valve element 18 being rotated. If the switching-off and restarting operation of the motor are effected rapidly enough, then the pressure in the delivery chamber 26 does not reduce to the extent that the valve element 18 can again move in the axial direction into its released position. This permits the impeller to always be driven in its preferred rotation direction, for which the blades are configured, on operation of the centrifugal pump assembly and to only use the opposite rotation direction for moving the valve element 18 in the opposite rotation direction.

Figure 7:
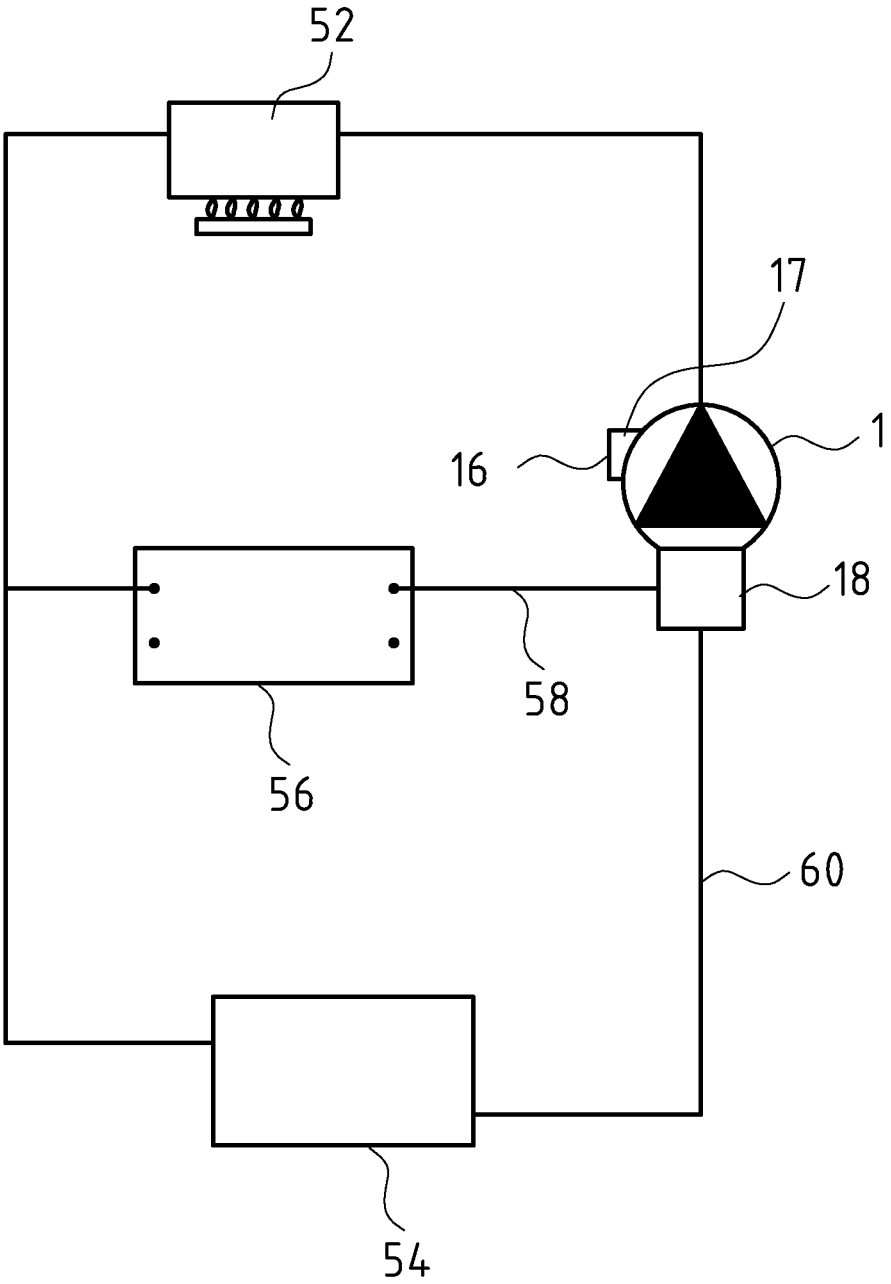
FIG. 7 is a schematic view of the hydraulic construction with a heating facility with a centrifugal pump assembly according to FIG. 1 to 6.

The described centrifugal pump assembly according to the first embodiment of the invention can be applied for example in a heating system as is shown in FIG. 7. Such a heating system is usually applied in apartments or houses and serves for heating the building or for the provision of heated service water. The heating facility comprises heat source 52, for example in the form of a gas heating boiler. A heating circuit 54 which leads for example through various radiators of a building is also present. A secondary heat exchanger 56, via which service water can be heated is moreover provided. A switch-over valve which selectively leads the heat transfer medium flow through the heating circuit 54 or the secondary heat exchanger 56 is usually required in such heating facilities. Regarding the centrifugal pump assembly 1 according to the invention, this valve function is assumed by the valve element 18 which is integrated into the centrifugal pump assembly 1. The control is effected by the control device 17 in the electronics casing 16. The heat source 52 is connected to the delivery branch 27 of the pump casing 12. A flow path 58 is connected to the suction branch 32, whereas a flow path 60 through the heating circuit 54 is connected to the suction branch 34. One can therefore switch between the flow path 58 through the secondary heat exchanger 56 and the flow path through the heating circuit 54 depending on the switching position of the valve element 18, without a valve with an additional drive becoming necessary.

Figure 8:
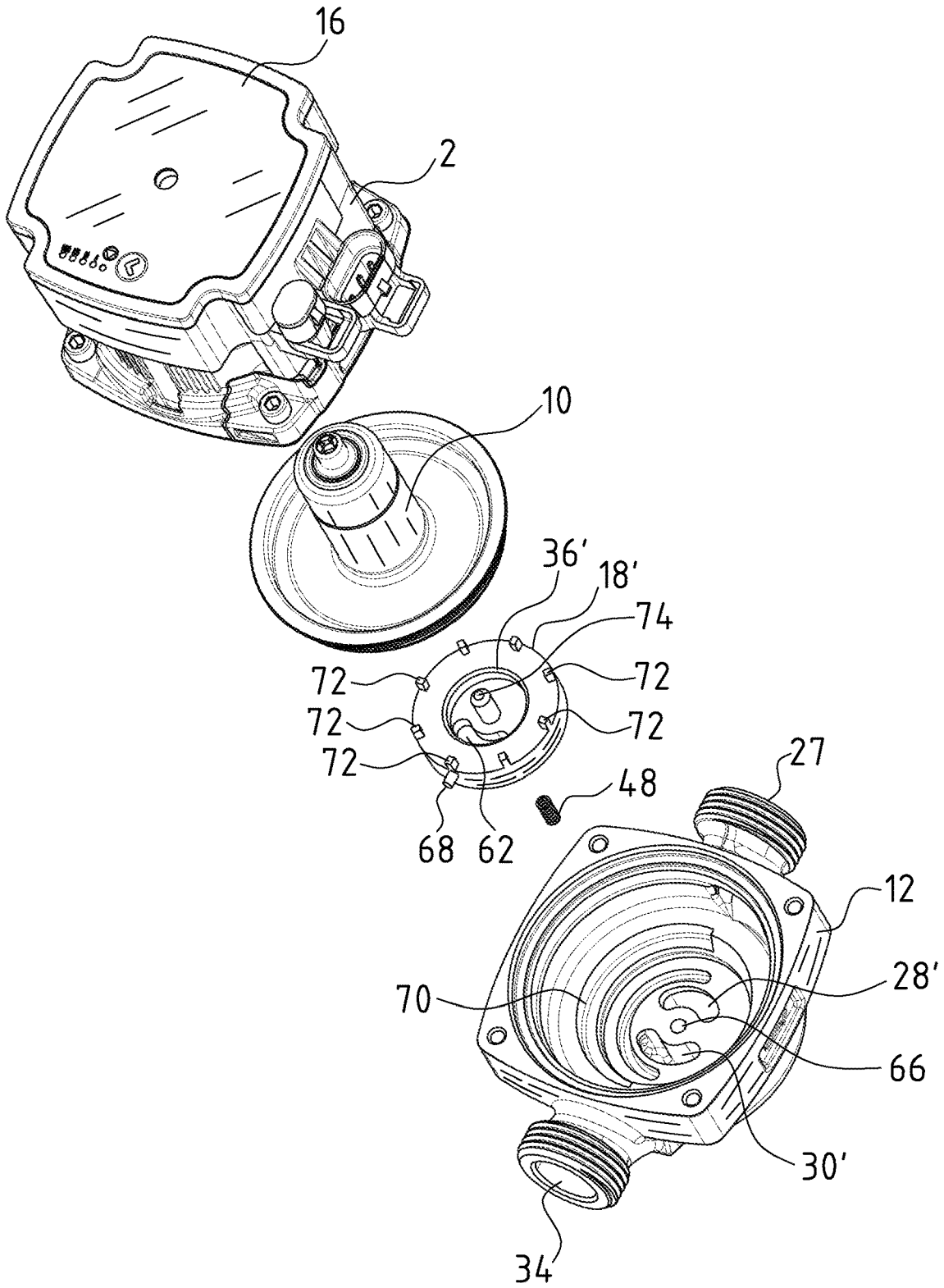
FIG. 8 is an exploded view of a centrifugal pump assembly according to a second embodiment of the invention.
Figure 10:
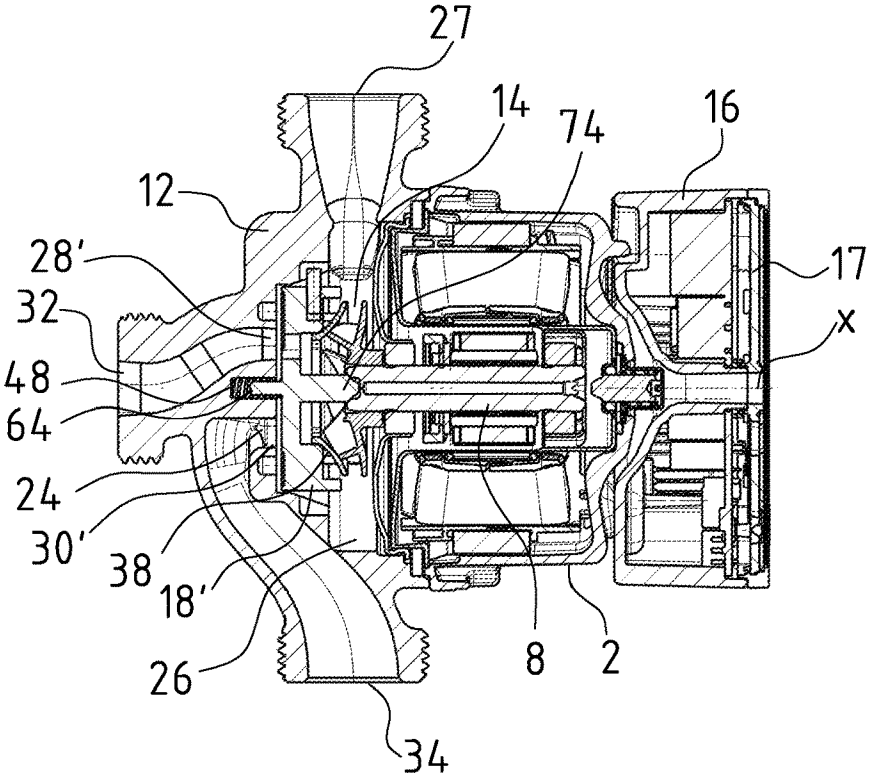
FIG. 10 is a sectioned view according to FIG. 9 with the valve element in a second position.
Figure 9:
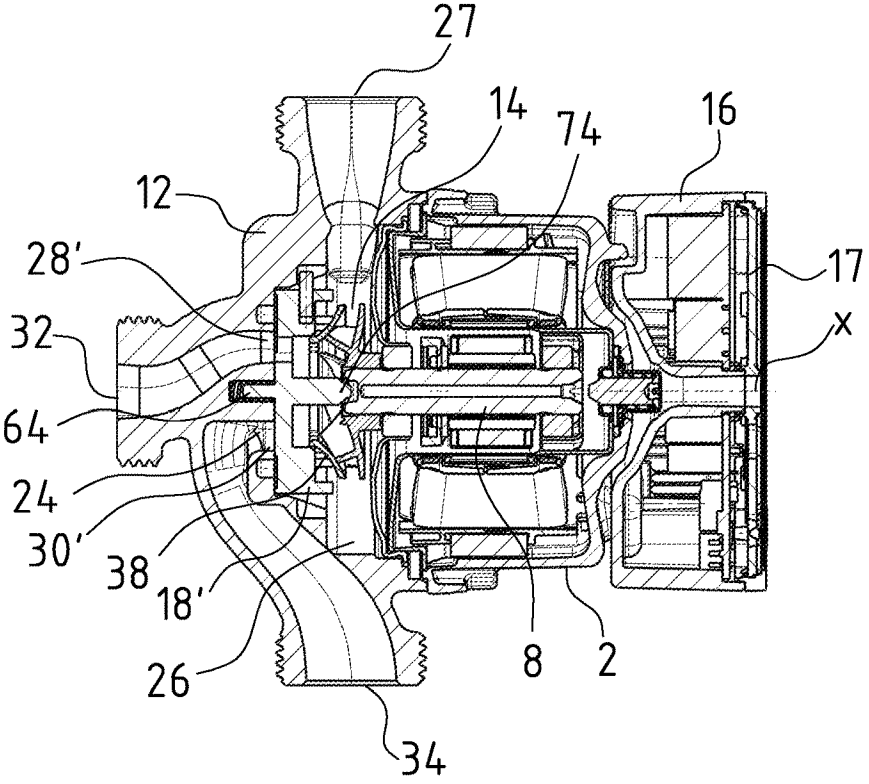
FIG. 9 is a sectioned view of the centrifugal pump assembly according to FIG. 8 with the valve element in a first position.

The second embodiment example according to FIG. 8 to 10 differs from the first embodiment example in respect to the construction of the valve element 18'. In this embodiment example too, the valve element 18' as a separating element separates the delivery chamber 26 from a suction chamber 24 of the pump casing 12 and forms a movable section of the flow-guiding wall of the delivery chamber 26. The valve element 18 comprises a central suction opening 36', into which the suction port 38 of the impeller 14 sealingly engages. Opposite the suction opening 36, the valve element 18' comprises an opening 62 which can be selectively brought to overlap with one of the inlets 28, 30 depending on the switching position of the valve element 18'. In this embodiment example, the inlets 28', 30' with regard to their shaping differ from the inlets 28, 30 according to the preceding embodiment. The valve element 18' comprises a central projection 64 which engages into a central hole 60 in the base of the pump casing 12 and is rotatingly mounted there about the rotation axis X. The projection 64 in the hole 66 simultaneously permits an axial movement along the rotation axis X, said movement being limited in one direction by the base of the pump casing 12 and in the other direction by the impeller 14. At its outer periphery, the valve element 18' comprises a pin 68 which engages into a semicircular groove 70 on the base of the pump casing 12. The ends of the groove 70 serve as stop surfaces for the pin 68 in the two possible switching positions of the valve element 18', wherein in a first switching position the opening 62 lies above the inlet 28' and in the second switching position the opening 62 lies above the inlet 30' and the respective other inlet is closed by the base of the valve element 18'. The rotation movement of the valve element 18' between the two switching positions in this embodiment example too is effected by the flow in the delivery chamber 26, said flow being caused by the impeller 14. The valve element 18' is provided with projections 72 which are directed into the delivery chamber 26, in order to be able to transmit this flow onto the valve element 18' in a better manner. If the centrifugal pump assembly 1 is taken out of operation, the spring 48 presses the valve element 18' into the released position which is shown in FIG. 10 and in which it does not bear on the base in the periphery of the inlets 28' and 30'. In this position, with a central pin 74 it axially abuts upon the face side of the motor shaft 8 and is limited in its axial movement by thus stop. If the pressure in the delivery chamber 26 is adequately large, the valve element 18' is pressed into the bearing (contacting) position which is shown in FIG. 9 and in which the valve element 18' comes to bear on the base of the pump casing 12 in the peripheral region of the inlets 28' and 30', and the pin 74 is simultaneously lifted from the face side of the rotor shaft 8. In this position, the rotor impeller 14 then rotates in normal operation of the centrifugal pump assembly.

Figure 11:
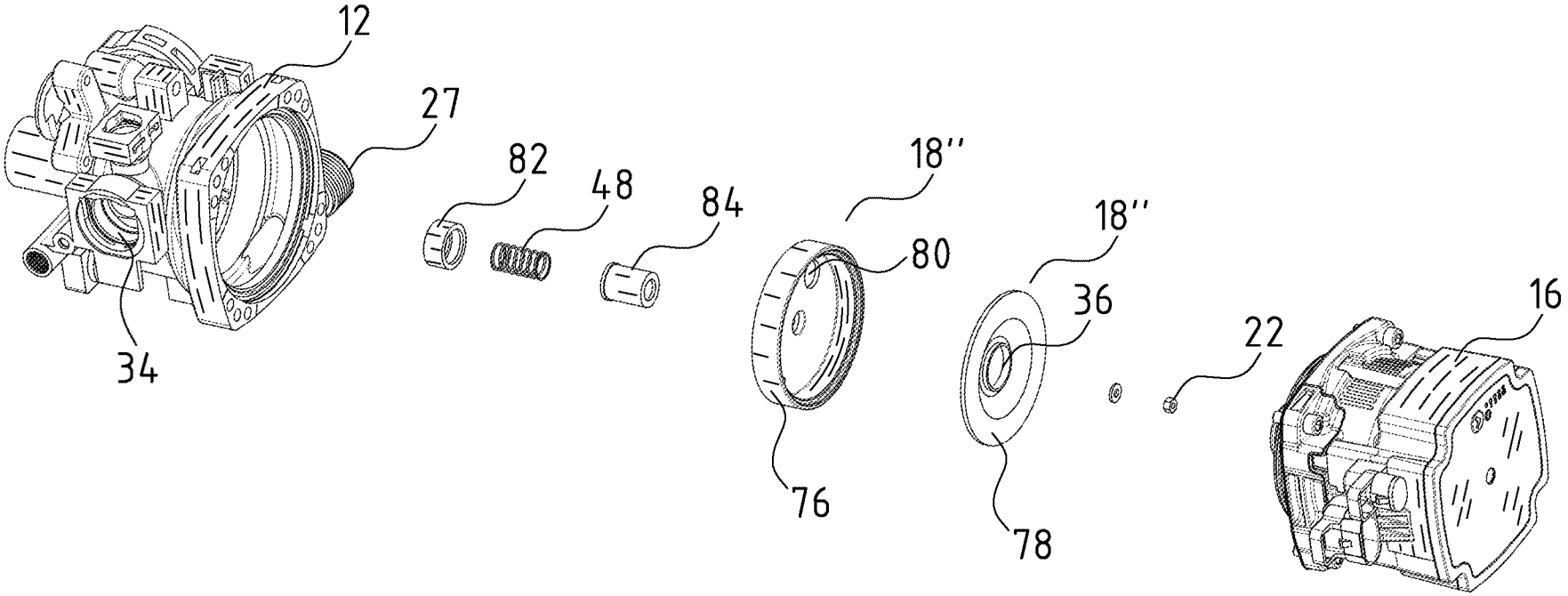
FIG. 11 is an exploded view of the centrifugal pump assembly according to a third embodiment of the invention.
Figure 13:
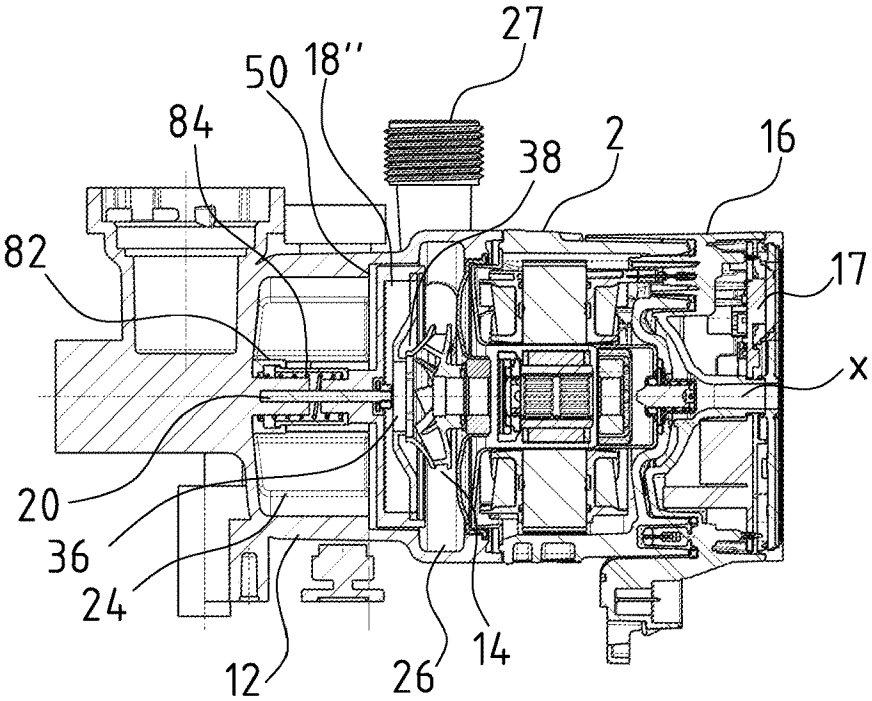
FIG. 13 is a sectioned view according to FIG. 12 with the valve element in a second position.
Figure 12:
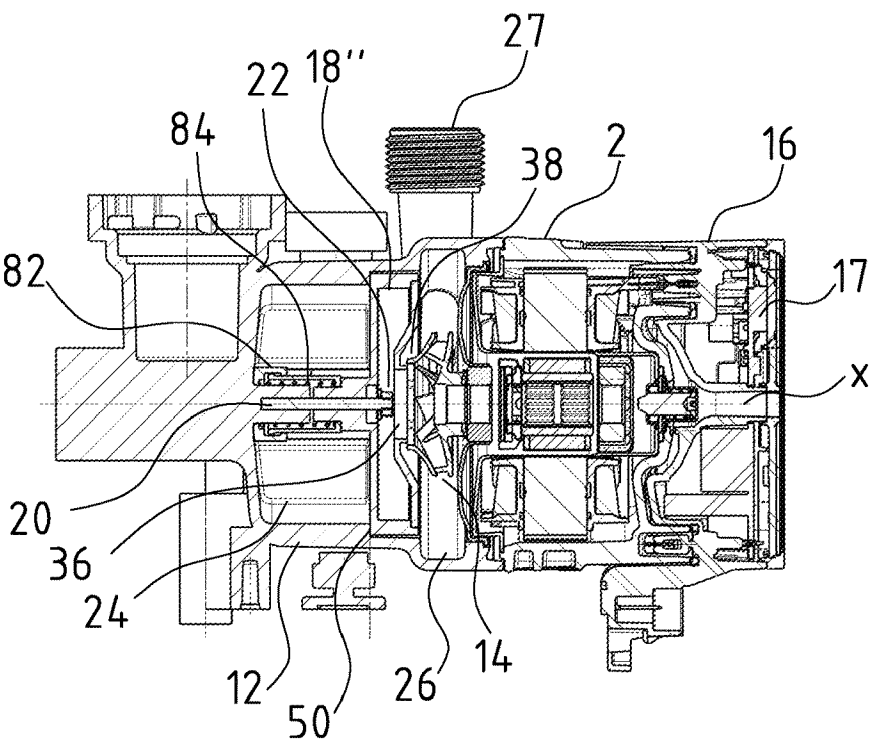
FIG. 12 is a sectioned view of the centrifugal pump assembly according to FIG. 11 with the valve element in a first position.

The third embodiment example according to FIG. 11 to 13 shows a further possible embodiment of the valve element 18". This embodiment example differs from the preceding embodiment examples with regard to the construction of the valve element 18". This valve element is configured as a valve drum. The pump casing 12 corresponds essentially to the construction according to FIG. 1 to 6, wherein in particular the arrangement of the inlets 28 and 30 corresponds to the arrangement which is described by way of the first embodiment example. The valve drum of the valve element 18" consists of a pot-like lower part which is closed by a cover 78. The cover 78 faces the delivery chamber 26 and comprises the central suction opening 36 which engages with its axially directed collar into the suction port 38 of the impeller 14. The cover 78 therefore forms a movable section of the flow-leading walls of the delivery chamber 26. At the opposite side, the base of the lower part 36 comprises an inlet opening 80 which is brought to overlap with one of the inlets 28, 30 depending on the switching position, whilst the respective other inlet 28, 30 is closed by the base of the lower part 26. The valve element 18" is rotatably mounted on a pivot 20 which is fastened in the base of the pump casing 12, wherein the rotation axis which is defined by the pivot 20 corresponds to the rotation axis X of the impeller 14. In this embodiment example too, the valve element 18" is axially displaceable along the pivot 20 by a certain amount, wherein a spring 48 which in the idle position presses the valve element 18" into its released position shown in FIG. 13 is present here too. In this embodiment example too, this axial position is limited by the nut 22. In the released position, the valve element 18" is rotatable by way of the flow which is created by the impeller 14 as described previously, which is to say a hydraulic coupling between the impeller 14 and the valve element 18" is created. In the bearing position which is shown in FIG. 12, on the one hand one of the inlets 28, 30 is sealingly closed depending on the switched position. On the other hand, a sealing between the suction chamber 24 and the delivery chamber 26 is effected due to the valve element 18" bearing on the contact shoulder 50.

In this embodiment example, the mounting of the valve element 18" on the pivot 20 is moreover encapsulated by two sleeves 82 and 84, so that these regions are protected from contamination by the delivered fluid and can be possibly pre-lubricated. A very easy-motion mounting is sought after, in order to ensure the easy rotatability of the valve element 18" by the flow which is caused by the impeller 14. It is to be understood that the mounting can be encapsulated accordingly also in the case of the other embodiment examples which are described here.

Figure 14:
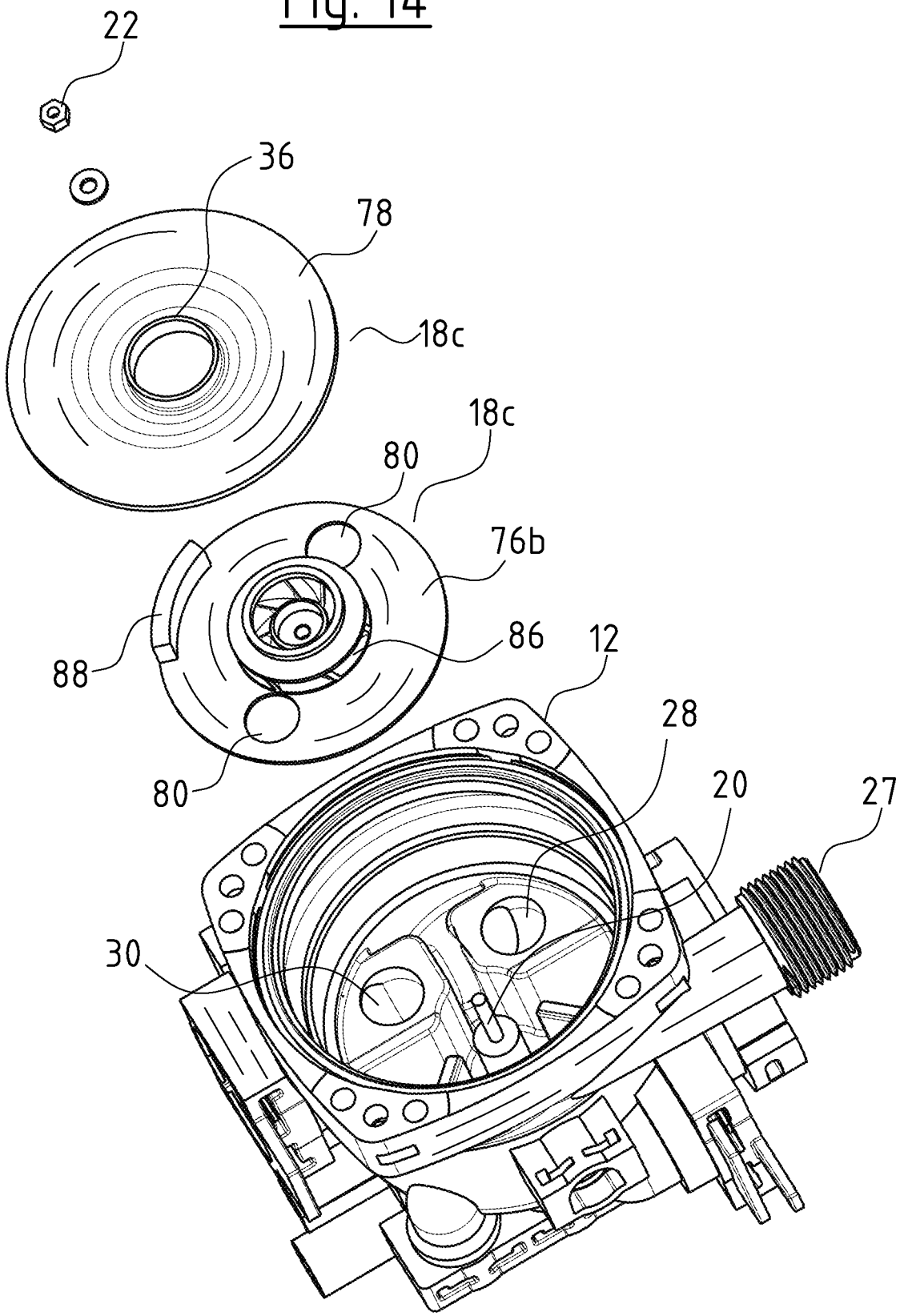
FIG. 14 is an exploded view of a pump assembly with a valve element according to a fourth embodiment of the invention.
Figure 15:
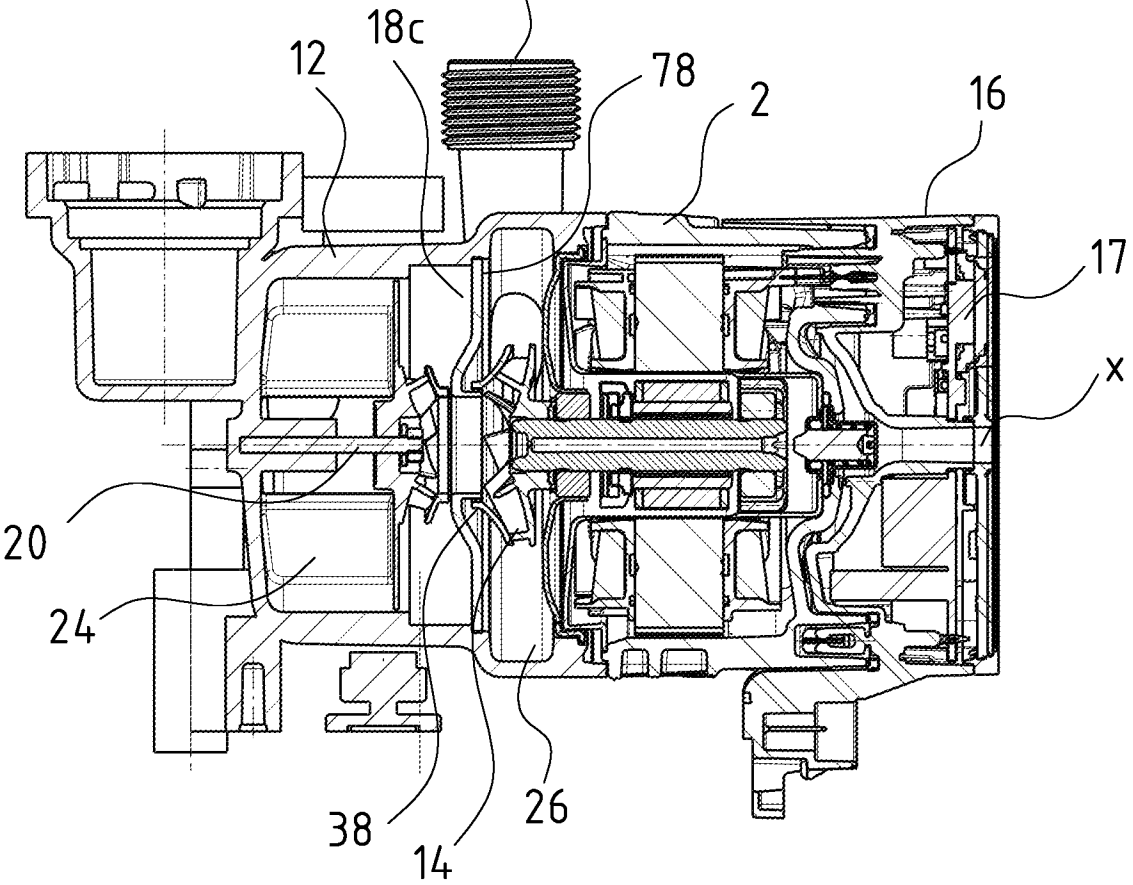
FIG. 15 is a sectioned view of a centrifugal pump assembly according to the fourth embodiment of the invention.

FIGS. 14 and 15 show a fourth embodiment example, concerning which the construction of the pump casing 12 corresponds to the construction of the pump casing 12 according to the first and the third embodiment example. In this embodiment example, the rotation movement of the valve element 18*c* is assisted by the suction-side flow, which is to say the flow which enters into the suction port 38 of the impeller 14. In this embodiment too, the valve element 18*c* is configured in an essentially drum-like manner and comprises a cover 28 which faces the delivery chamber 26 and which is with a central suction opening 36 which is engaged with the suction port 38 as has been described beforehand. The lower part 76*b* which is shown here comprises two entry openings 80 which can be brought to overlap with one of the inlets 28, 30 depending on the switching position, wherein the respective other inlet 28, 30 is sealingly closed by the base of the lower part 46*b*, as has been described with the preceding embodiment example. Guide vanes 86 with blades, into which the flow enters radially from the inlet openings 80 and exits axially to the central suction opening 36 are arranged between the lower part 76*b* and the cover 78. The guide vanes 86 are a flow-guiding component which with its walls serves for flow guidance and as a movable part of the flow-guiding walls can be co-moved by the flow. A torque about the pivot 20 is also produced by the blades of the guide vanes 86, by way of which torque the valve element 18*c* can be moved between the switching positions. This functions essentially as has been described previously. A spring 48, as has been described previously, can additionally be provided, in order to move the valve element 18*c* into a released position. With this embodiment example, the restoring movement is effected by a weight 88, since a torque is always produced in the same direction independently of the direction, in which the impeller 14 rotates, on account of the shaping of the blades of the guide vanes 86. On operation, the centrifugal pump assembly is always situated in the installation position which is shown in FIG. 15 and in which the rotation axis X extends horizontally. When the centrifugal pump assembly is switched off, the valve element 18*c* always rotates about the pivot 20 such that the weight 88 lies at the bottom. The valve element 18*c* can be rotated against this restoring force which is produced by the weight 88, by way of the torque produced by the guide vanes 86, wherein a pressure can be built up in the delivery chamber 26 in such a rapid manner by way of a very rapid starting operation of the drive motor, that the valve element 18*c* gets into its bearing position as has been described above, in which position it is non-positively held on the pump casing 12 in a rotationally fixed manner without having to be moved out of its idle condition. It is to be understood that a restoring of the valve element by way of gravity or by way of another restoring force independently of the drive could also be applied to the other embodiment examples which are described here.

Figure 16:
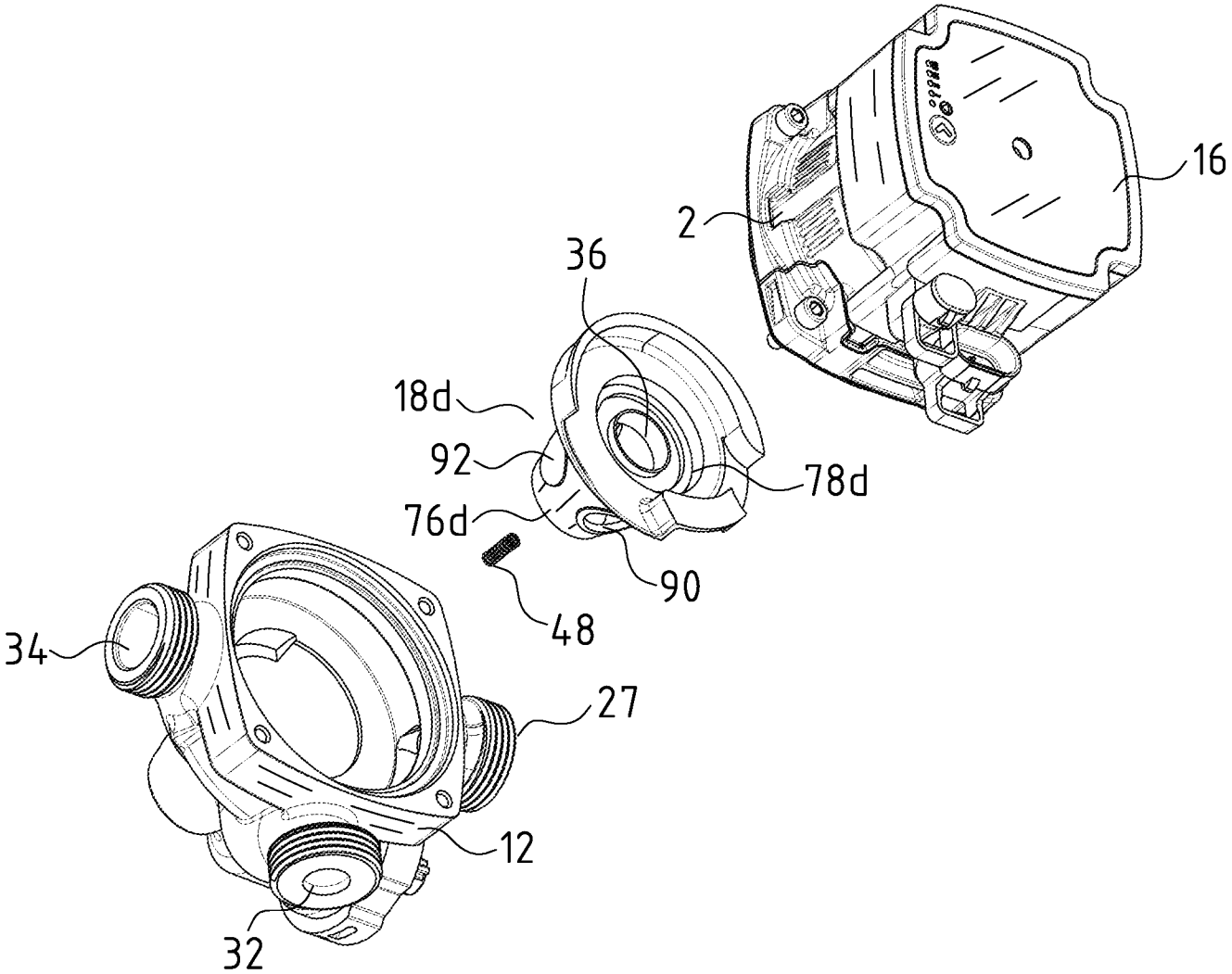
FIG. 16 is an exploded view of a centrifugal pump assembly according to a fifth embodiment of the invention.
Figure 18:
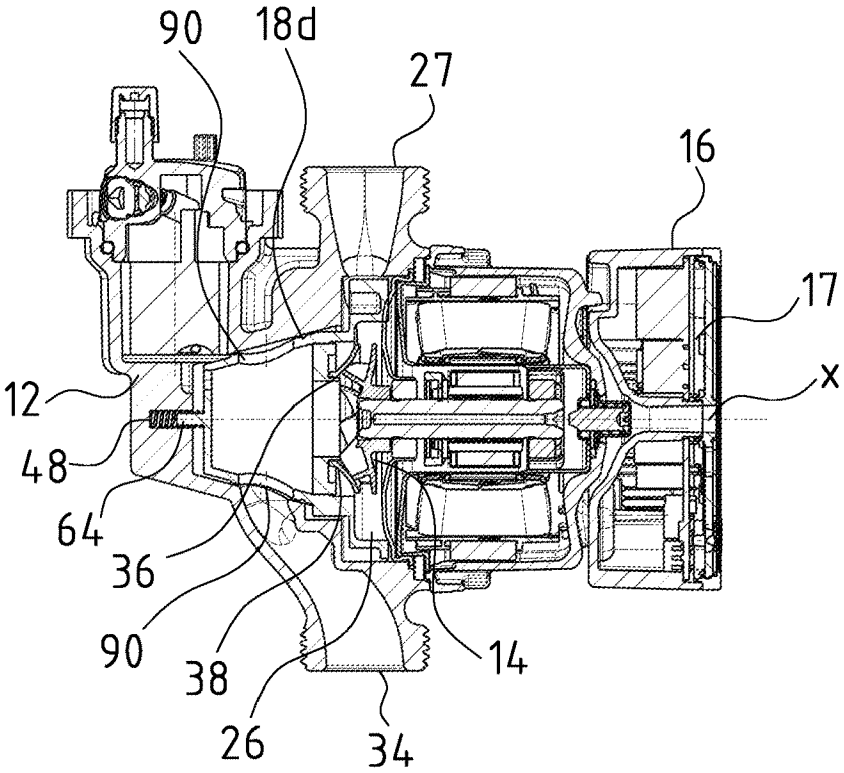
FIG. 18 is a sectioned view according to FIG. 17 with the valve element in a second position.
Figure 17:
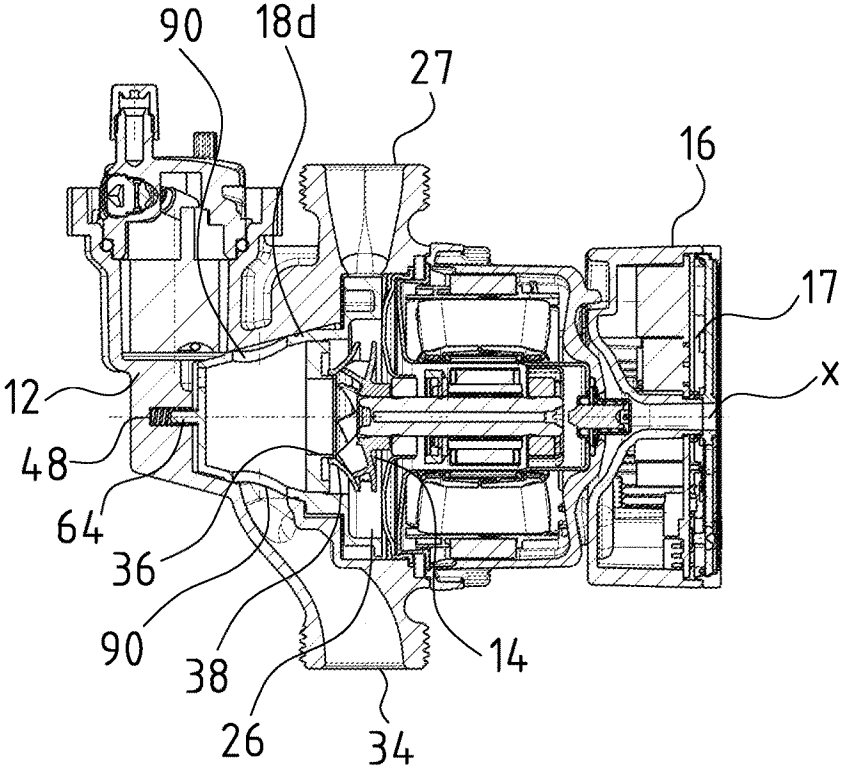
FIG. 17 is a sectioned view of the centrifugal pump assembly according to FIG. 16 with the valve element in a first position.

The fifth embodiment example according to FIG. 16 to 18 differs from the preceding embodiment examples again in the construction of the valve element. With regard to this embodiment example, the valve element 18*d* is configured conically. The valve element 18*d* comprises a conical, pot-like lower part 76*d* which is closed by a cover 78*d*, wherein a central suction opening 36 which is engaged with the suction port 38 of the impeller 14 in the previously described manner is again formed in the cover 78*d*. The cover 78*d* is adjacent to the delivery chamber 26 and there forms a movable section of the flow-leading wall. Inlet openings 90 which by way of rotating the valve element 18*d* can be selectively brought to overlap with inlets which are connected to the suction branches 32 and 34, in order to create a flow path through the inside of the valve element 18*d* to the suction opening 36 are formed in the conical peripheral surface of the lower part 76*b*. Sealing surfaces 92 which can close the respective other inlet are formed on the conical lower part between the inlet openings 90. As also with the second embodiment example according to FIGS. 8 and 10, here the valve element 18*d* also comprises a pin-like projection 64 which engages in a recess on the base of the pump casing 12 and there rotatably mounts the valve element 18*d* about the rotation axis X. Here too, an axial movement is possible between a released position, as is shown in FIG. 18 and a bearing position as is shown in FIG. 17. In the released position, the lower part 76*d* of the valve element 18*d* essentially does not bear on the pump casing 12 so that it can be rotated by the flow in the delivery chamber 26 as has been described with regard to the previously described embodiment examples. Here, a to-and-fro movement of the valve element 18*d* can again be achieved in a manner dependent on the rotation direction of the impeller, wherein here too, the rotation movement of the valve element 18*d* can also be limited by stops which are not shown. In the bearing position according to FIG. 17, on the one hand a sealing bearing contact of the valve element 18*d* is effected, and on the other hand it is non-positively held, so that again, as long as the pressure in the delivery chamber 26 is sufficiently large, it is not moved between the switching positions even given a direction change of the impeller 14.

While specific embodiments of the invention have been shown and described in detail to illustrate the application of the principles of the invention, it will be understood that the invention may be embodied otherwise without departing from such principles.

The invention claimed is:

1. A hydraulic construction unit with a centrifugal pump assembly comprising:

an electrical drive motor;

at least one impeller which is driven by the electrical drive motor;

at least one valve element arranged to be movable by a fluid flow which is created by the at least one impeller; and a wall delimiting a flow path in the hydraulic construction unit, the wall comprising at least one moveable wall section that is part of the at least one valve element or is connected to the at least one valve element for movement, wherein a movement of the at least one movable wall section is at least partly effected by friction forces of fluid flow running along the wall, wherein a movable separating element separates a suction chamber in an inside of a pump casing of the centrifugal pump assembly from a delivery chamber which surrounds the at least one impeller, wherein a surface of the separating element which faces the delivery chamber and/or a surface of the separating element which faces the suction chamber forms the at least one movable wall section of the wall.

2. A hydraulic construction unit according to claim 1, wherein the at least one movable wall section of the wall is arranged to be movable parallel to the fluid flow which runs along the wall.

3. A hydraulic construction unit according to claim 1, wherein the at least one movable wall section of the wall delimits a flow path which extends from the centrifugal pump assembly at a delivery side.

4. A hydraulic construction unit according to claim 1, wherein the at least one movable wall section of the wall delimits a flow path which extends from the centrifugal pump assembly at a suction side.

5. A hydraulic construction unit according to claim 1, wherein the at least one movable wall section of the wall is configured and arranged such that the at least one movable wall section of the wall is movable together with the at least one valve element by way of energy loss which is caused by the frictional forces on the wall of the flow path.

6. A hydraulic construction unit according to claim 1, wherein the at least one moveable wall section of the wall is rotatably mounted in a pump casing.

7. A hydraulic construction unit according to claim 6, wherein the at least one movable wall section is configured such that the friction forces which act upon the at least one moveable wall, by way of the fluid flow, are larger than friction forces which occur in a mounting of the at least one movable section and of the at least one valve element.

8. A hydraulic construction unit according to claim 1, wherein the separating element annularly surrounds a suction port of the at least one impeller.

9. A hydraulic construction unit according to claim 1, wherein the separating element is formed by the at least one valve element.

10. A hydraulic construction unit according to claim 9, wherein the at least one valve element is rotatably mounted on a central bearing, wherein the rotation axis of the at least one valve element extends so as to be aligned to the rotation axis of the drive motor.

11. A hydraulic construction unit according to claim 1, wherein the at least one valve element is movable between at least two switching positions.

12. A hydraulic construction unit according to claim 11, wherein the at least one valve element interacts with at least two valve openings of two flow channels such that the valve openings of the flow channels are opened to a different extent depending on the switching position of the at least one valve element.

13. A hydraulic construction unit according to claim 12, wherein the at least two valve openings each span a surface which extends parallel to a movement direction of the at least one valve element between at least two switching positions.

14. A hydraulic construction unit according to claim 1, wherein the at least one valve element is configured and arranged such that the at least one valve element is movable along a first movement path between at least two switching positions by way of the fluid flow and additionally can be subjected to force or is movable, along a second movement path, by way of a pressure which is produced by the impeller, wherein the second movement path runs angled relative to the first movement path.

15. A hydraulic construction unit according claim 14, wherein the at least one valve element is movable along the second movement path between a first released position, in which the at least one valve element is movable between the at least two switching positions, and a bearing position, at which the at least one valve element bears upon at least one contact surface.

16. A hydraulic construction unit according to claim 15, wherein the at least one valve element and the contact surface are configured such that the at least one valve element and the contact surface non-positively or positively engage with one another in the bearing position, wherein a greater force is transmitted via this engagement than between the fluid flow and the at least one movable wall section of the wall.

17. A hydraulic construction unit according to claim 1, wherein the at least one moveable wall section of the wall is rotatably mounted in a pump casing and together with the at least one valve element is rotatably mounted in the pump casing.

* * * * *